United States Patent [19]

Holley

[11] Patent Number: 4,458,461

[45] Date of Patent: Jul. 10, 1984

[54] SUPPORT POSTS AND/OR A PARTITIONING SYSTEM

[75] Inventor: Leonard A. Holley, Auckland, New Zealand

[73] Assignee: Planscape Systems (N.Z.) Limited, Auckland, New Zealand

[21] Appl. No.: 402,326

[22] Filed: Jul. 27, 1982

[30] Foreign Application Priority Data

Jul. 27, 1981 [NZ] New Zealand ..... 197859

[51] Int. Cl.[3] ..... E04H 1/00; E04B 1/00

[52] U.S. Cl. ..... 52/239; 52/241; 52/282

[58] Field of Search ..... 52/239, 282, 238, 241, 52/731, 730

[56] References Cited

U.S. PATENT DOCUMENTS

| | | | |
|---|---|---|---|
| 2,990,037 | 6/1961 | Fowles | 52/238.1 |
| 3,312,025 | 4/1967 | Deakins | 52/239 |
| 3,818,661 | 6/1974 | Pragg | 52/282 |
| 3,834,092 | 9/1974 | Whisson | 52/282 |

FOREIGN PATENT DOCUMENTS

| | | | |
|---|---|---|---|
| 240287 | 8/1962 | Australia | 52/238.1 |
| 1311348 | 10/1962 | France | 52/239 |

*Primary Examiner*—John E. Murtagh
*Assistant Examiner*—Andrew Joseph Rudy
*Attorney, Agent, or Firm*—Wenderoth, Lind & Ponack

[57] ABSTRACT

A partitioning system includes a plurality of support posts between which are carried partitions or panels. The support posts have slots therein into which key members positioned on the ends of the panels or partitions may be placed. At each end of the support posts are provided key caps which also include slots into which part of the key members may be positioned.

16 Claims, 5 Drawing Figures

SUPPORT POSTS AND/OR A PARTITIONING SYSTEM

BACKGROUND OF THE INVENTION

This invention relates to a support post and/or a partitioning system.

With partitioning systems as currently available it has been necessary to make substantially fixed and permanent connections between the parts in order to obtain a durable partition. This has, meant that where it is desired to move the partitioning, dismounting and reassembling the partitioning has been difficult and in may cases cannot be effected without a severe deliterious effect on the partitioning. In order to overcome this disadvantage free standing partition elements have been provided and a wall or partition is formed by placing one or more of such elements in close mutual proximity. Such partitioning has tended to give an untidy and irregular appearance and gives the impression of a temporary measure which in many instances is undesirable.

SUMMARY OF THE INVENTION

It is therefore an object of the present invention to provide a support post and/or a partitioning system which will go at least some distance towards overcoming the foregoing disadvantages or which will at least provide the public with a useful choice.

Accordingly in one aspect the invention consists in a support post, to in use support one or more partitions or panels, comprising a pair of key caps, a hollow post element in the form of a three sided channel member, interengaging connection means between each key cap and the hollow post element, a plurality of longitudinal slots in the post element, such slots being open at the ends thereof, a plurality of slots in the key caps and being open at the edge of the key cap which in use abuts said post element, and key members associable with a panel or partition so that in use a panel or partition may be engaged with the key caps and/or the support posts by engagement of one or more of the key members into a and an insert removably positionable in the open side of the hollow post element slot.

In a further aspect the invention consists in a partitioning system comprising a plurality of support posts each support post comprising a pair of key caps, a hollow post element in the form of a three-sided channel member, interengaging connection means between each key cap and the hollow post element, a plurality of longitudinal slots in the hollow post element, such slots being open at the ends thereof, a plurality of slots in the key caps and being open at the edge of the key cap which in use abuts the hollow post element, one or more partitions or panels, key members associable with each panel or partition so that in use a panel or partition may be engaged with a a key cap and/or support post by engagement of one or more of the key members into a said slot so that each partition or panel may be engaged between a pair of support posts and inserts removably positionable into the open side of the hollow post element.

To those skilled in the art to which this invention relates, many changes in construction and widely differing embodiments and applications of the invention will suggest themselves without departing from the scope of the invention as defined in the appended claims. The disclosures and the descriptions herein are purely illustrative and it is not intended to limit the scope of the invention by those disclosures and descriptions, or otherwide, than by the terms of the appended claims.

The invention consists in the foregoing and also envisages constructions of which the following gives examples.

BRIEF DESCRIPTION OF THE DRAWINGS

One preferred form of the invention will now be described with reference to the accompanying drawings in which.

DETAILED DESCRIPTION OF THE INVENTION

Figure 1:
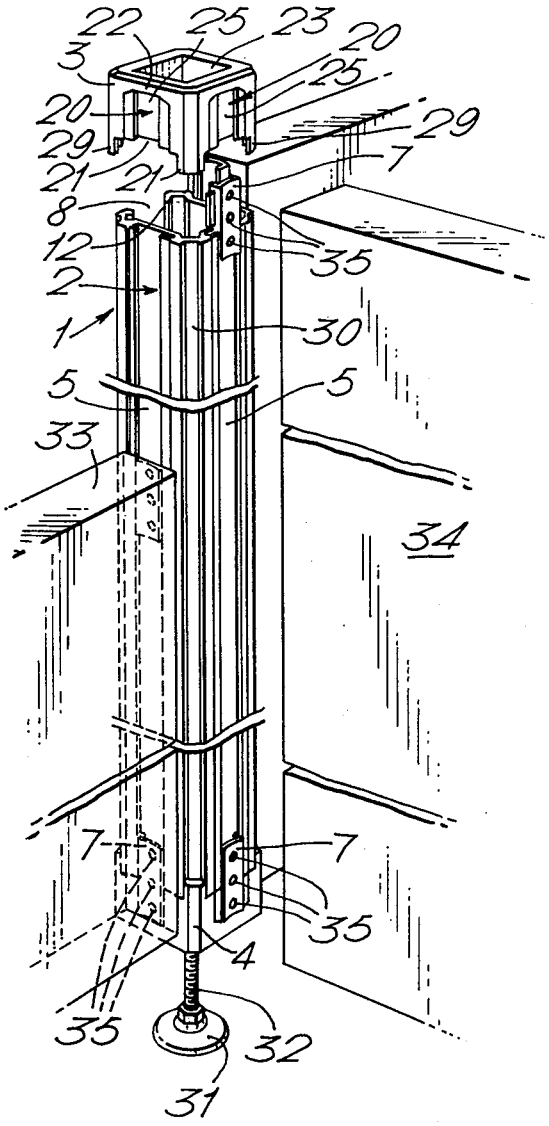
FIG. 1 is a diagrammatic perspective elevation of a support post and partitioning system according to one form of the invention.
Figure 2:
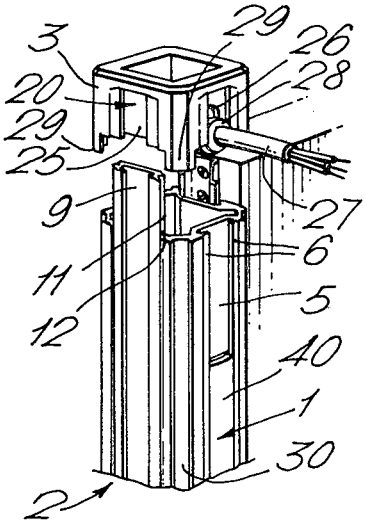
FIG. 2 is a diagrammatic perspective view of the top part of a support post showing the provisions of services.

Referring to the drawings, a support post and partitioning system are provided as follows:

The support post 1 comprises a hollow post element 2 and a pair of key caps. The key caps preferably comprise an upper key cap 3 and a lower key cap 4.

The support post 2 includes a plurality of slots therein for example slots 5 which slots are narrower at the mouth thereof than at the internal parts so that a winged key member 7 may be positioned with the slot. Thus slots 5 may be formed by a pair of mutually inwardly directed flanges 6 so that the slots 5 are substantially in one plane.

The post element 2 is preferably substantially a three-sided channel having one open face 8 which may receive an insert 9 which insert 9 preferably provides a slot 10 substantially similar to the slots 5.

The insert 9 preferably has side channels 11 into which are positioned the side edges 12 of the open face 8 for example by spring fit.

The support post 2 is preferably recessed at the corners as shown at 13 so that a dividing strip 14 of for example a flexible material such as a plastics material may span between a pair of such recesses to provide an infill strip to separate for example power and telephone cables housed within the support post 2.

In the upper key cap 3 slots 20 are provided which are open at the lower edge 21 which abuts the support post 2 and are preferably closed at the upper end 22.

Thus when the cap 3 is on the post 2 the slots 20 align with the slots such as slots 5 and 10.

The key cap 3 preferably has an opening 23 at the upper end thereof which if required can receive, for example, by a pressure fit, a pin or spigot such as annular pin 24.

The rear surface 25 of at least one of the slots 20 preferably has an aperture 26 through which services such as power or telephone cables 27 may be inserted. Also cables could pass through aperture 23 or an aperture or apertures in the bottom of key cap 4.

The width of the aperture 26 is preferably such as to receive a suitable electrical grommet 28.

Interengaging connection means are provided between the post 2 and the key caps 3 and 4 and these preferably comprise corner tongue 29 on the key caps 3 and 4 and corner groove 30 on the support post 2.

The arrangement is such that when the key cap 3 or 4 abuts the post 2 the tongue 29 extends downwardly into the groove 30.

The key members 7 are preferably greater in length than the length of the slot 20 so that when the key member is positioned in a slot 20 at least part of the key member 7 will extend into a slot 5 or 10.

The lower key cap 4 is substantially similar and again provides apertures through which services may be provided.

It is desirable however that a foot 31 be provided and this may include a threaded screw 32 positionable into a tapped aperture in the underside of the key cap 4.

The key cap 4 includes apertures for services in at least one slot base similar to base 25 in key cap 3 and also preferably on the underside of the key cap 4.

Panels such as panels 33 and 34 are provided and at the ends of the panels such as panel 34 key members such as key members 7 are engaged by, for example, passing screws through apertures such as apertures 35 in the key member 7.

It is desirable to provide at least a pair of key members 7 at each end of the panel 34.

Panel 33 is provided in a similar manner but is of a shorter height and in such a construction in one embodiment it is desirable that at least one aperture 35 of the key member 7 extends beyond particularly the lower edge of the panel 33.

It is desirable that the groove 30 be provided with apertures 37 to allow clipping access and load bearing facilities in shear.

Figure 3:
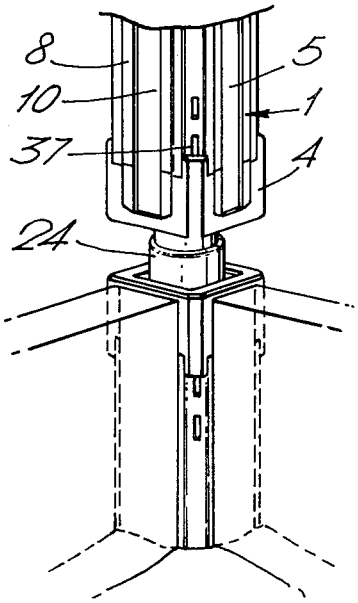
FIG. 3 is a diagrammatic perspective view of parts of two support posts showing a method whereby the support posts may be longitudinally engaged one with the other.
Figure 4:
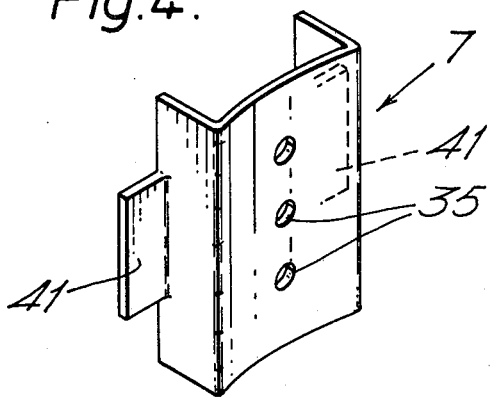
FIG. 4 is a perspective view of a key member for use in the invention.
Figure 5:
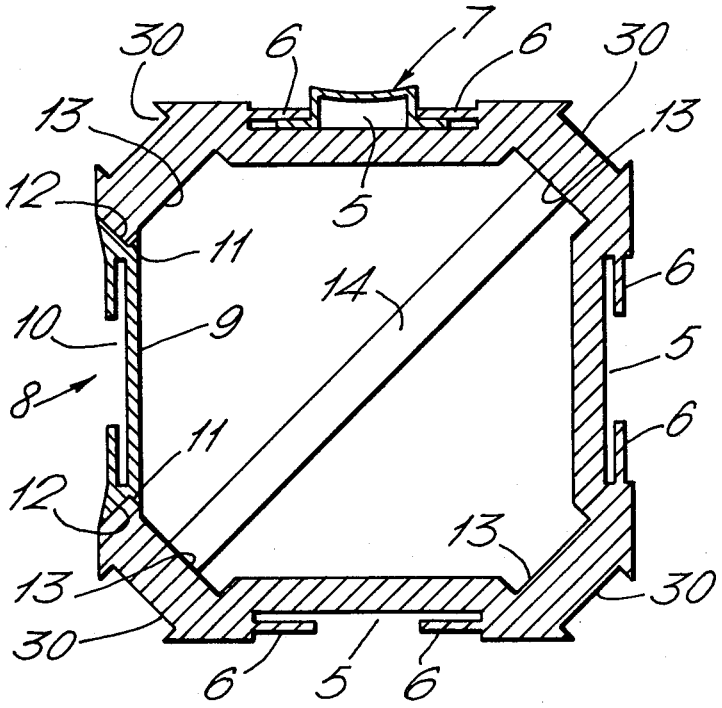
FIG. 5 is a cross section of a support post for use in the invention.

To engage posts as shown in FIG. 3 a pin or spigot 24 can be engaged into the aperture 23 and on the underside of the upper post either a similar engagement may be made or alternatively the foot 31 may have a slot therein into which the upper end of the annular spigot may be placed or indeed the key cap 4 itself may have such a slot or two key caps 3 may be used.

For slots which are not to be engaged by a panel a decorative inlay 40 may be provided.

In use a lower key cap is engaged with a post 2. Key members 7 are also engaged at the ends of panels such as panels 33 or 34.

The key members of these panels are then slid into an appropriate slot and the post stood upright.

The upper key cap 3 is then placed on the post 2 in a manner such that part of the key member 7 extends into the slot 20, providing the panel 34 is of sufficient height.

Where a panel such as panel 33 is provided the positioning so far as height is concerned of the panel in relation to the post 2 may be varied for example by placing a further key member 7 in the slot and passing for example grub screws or the like through an aperture 35 to clamp the key member in the slot and provide a barrier for the panel 33. Alternatively such a screw may be placed through a free hole extending beyond for example the far edge of the panel in a key member 7.

The key members 7 have wings such as wings 41 which are positioned into the side parts of the slots such as slots 5 or 10.

The construction is such to allow one, two, three or four panels to be engaged with a post of the type shown in the drawings, but, of course, posts with different numbers of faces may be provided.

Services such as cables 27 may be positioned into the hollow interior of the post 2 by being fed in through, for example, the lower key cap 4 or alternatively through gaps provided for example in the cover extrusion or insert 9 or simply by providing this integer in lengths so that gaps can be provided between adjacent lengths.

Thus it can be seen that in the preferred form of the invention a support post and/or a partitioning system are provided which have the advantages that the key caps provide an integral mechanism for joining partitions or panels at the top and bottom corners and are able to provide right angled joint facilities up to and including four panels, although a greater or lesser number of panels could be provided for a reshaped post.

Electrical access is able to be provided at the top and the bottom and also through the post itself. Total access may be similarly gained and the power and telephone cabling can be kept separate by the provision of an infill strip.

The support post may carry articles clipped or hung onto the post.

Panels of varying height may be accommodated by suitably positioning the key members and can also be used for the hanging of accessories such as lights or doors.

The slots in the posts allow for decorative inlays of for example fabrics, wood veneers or other feature strips. The slots also enable facilities for glazing to be provided and also the posts may be extended in height by use of a spigot and further post section.

Thus it can be seen that a support post and/or a partitioning system are provided which at least in the preferred form of the invention have the advantage that the partitioning can be erected on site, in a simple yet effective manner, requiring a minimum of tools and fixed connections to be made. Once the panels have the key members mounted thereon, further engagement of the parts does not require permanent connections and the partitioning formed using the support posts and/or the partitioning system of the invention is readily demountable. However, when erected by virtue of the provision of the support posts, the partitioning is durable and also provides a regular appearance of interconnected panels which is desirable.

What is claimed is:

1. A support post for use in supporting one or more partitions or panels, said support post comprising:

a hollow post element in the form of a three-sided channel member with an open side;

an elongated insert removably positionable in said post element to close said open side thereof;

a plurality of longitudinally extending slots formed in the exterior of said post element, said slots being open at opposite ends thereof;

a pair of key caps;

connection means for connecting each said key cap to a respective end of said post element;

each said key cap having formed in the exterior thereof a plurality of slots, each of which is open at an end thereof at an edge of said key cap which in use abuts a respective end of said post element; and key members dimensioned to be insertable into said slots in said key caps and said post element, and adapted to be connected to a panel or partition such that such panel or partition may be engaged with said key caps and/or said post element by insertion of at least one said key member into at least one said slot.

2. A support post as claimed in claim 1, wherein said key member has a length greater than the length of said slots in said key caps, such that when said key member is inserted in a said key cap slot, said key member extends therefrom into a respective said slot in said post element.

3. A support post as claimed in claim 1, wherein said three-sided channel member has a said slot in each said side thereof, and said insert has therein a slot, such that said channel member and said insert form generally a rectangular shape with each of the four sides thereof having a slot.

4. A support post as claimed in claim 3, wherein each said key cap has a generally rectangular cross-sectional shape, each of the four sides thereof having a slot.

5. A support post as claimed in claim 1, wherein at least one said key cap has therein at least one aperture to enable the passage into the interior of said post element of services.

6. A support post as claimed in claim 1, wherein each said slot has a narrowed mouth with side slot portions on opposite sides thereof, and each said key member has oppositely extending wings fitting into said side slot portions.

7. A support post as claimed in claim 1, wherein said connection means comprise channels in the exterior of said post element, and tongues extending from each said key cap, said tongues fitting into said channels.

8. A support post as claimed in claim 7, wherein each said channel is positioned at a respective corner of said post element, and each said tongue extends from a respective corner of each said key cap.

9. A partitioning system comprising:

at least one partition or panel;

a plurality of support posts, each comprising:

a hollow post element in the form of a three-sided channel member with an open side, an elongated insert removably positionable in said post element to close said open side thereof, a plurality of longitudinally extending slots formed in the exterior of said post element, said slots being open at opposite ends thereof, a pair of key caps, and connection means for connecting each said key cap to a respective end of said post element, each said key cap having formed in the exterior thereof a plurality of slots, each of which is open at an end thereof at an edge of said key cap which in use abuts a respective end of said post element; and key members dimensioned to be insertable into said slots in said key caps and said post element, and connected to said panel or partition such that said panel or partition may be engaged with said key caps and/or said post element by insertion of at least one said key member into at least one said slot.

10. A system as claimed in claim 9, wherein each said key member has a length greater than the length of said slots in said key caps, such that when said key member is inserted in a said key cap slot, sand key member extends therefrom into a respective said slot in said post element.

11. A system as claimed in claim 9, wherein each said three-sided channel member has a said slot in each said side thereof, and the respective said insert has therein a slot, such that said channel member and said insert form generally a rectangular shape with each of the four sides thereof having a slot.

12. A system as claimed in claim 11, wherein each said key cap has a generally rectangular cross-sectional shape, each of the four sides thereof having a slot.

13. A system as claimed in claim 9, wherein at least one said key cap has therein at least one aperture to enable the passage into the interior of said post element of services.

14. A system as claimed in claim 9, wherein each said slot has a narrowed mouth with side slot portions on opposite sides thereof, and each said key member has oppositely extending wings fitting into said side slot portions.

15. A system as claimed in claim 9, wherein each said connection means comprise channels in the exterior of the respective said post element, and tongues extending from each said key cap, said tongues fitting into said channels.

16. A system as claimed in claim 15, wherein each said channel is positioned at a respective corner of said post element, and each said tongue extends from a respective corner of each said key cap.

* * * * *